US005765808A

United States Patent [19]

Butschbacher et al.

[11] Patent Number: 5,765,808

[45] Date of Patent: Jun. 16, 1998

[54] LAYING AID FOR PARQUET FLOORING

[75] Inventors: Ernst Butschbacher, Eschelbronn; Hans Roesch, Gemmrigheim, both of Germany

[73] Assignee: Bessey & Sohn GmbH & Co., Bietigheim-Bissingen, Germany

[21] Appl. No.: 762,184

[22] Filed: Dec. 9, 1996

[30] Foreign Application Priority Data

May 11, 1995 [DE] Germany ..... 295 07 795.6

[51] Int. Cl.[6] ..... B25B 5/16

[52] U.S. Cl. ..... 254/200; 254/209; 254/199

[58] Field of Search ..... 254/11, 17, 213, 254/214

[56] References Cited

U.S. PATENT DOCUMENTS

| | | | |
|---|---|---|---|
| 1,161,207 | 11/1915 | Hagel | 254/11 |
| 2,676,784 | 4/1954 | Howard | 254/17 |
| 3,143,335 | 8/1964 | Lassahn | 254/11 |
| 4,280,683 | 7/1981 | Knierim | 254/17 |
| 4,332,203 | 6/1982 | Flowers | 254/11 |
| 4,592,536 | 6/1986 | Jasinski | 254/17 |
| 4,683,631 | 8/1987 | Dobbertin | 254/11 |
| 4,753,426 | 6/1988 | Varkala . | |
| 5,181,703 | 1/1993 | Gilstad et al. | 254/11 |

FOREIGN PATENT DOCUMENTS

| | | |
|---|---|---|
| 88 16 166.8 | 8/1989 | Germany . |
| 43 04 992 | 9/1993 | Germany . |

*Primary Examiner*—Katherine Matecki
*Attorney, Agent, or Firm*—Barry R. Lipsitz

[57] ABSTRACT

In order to provide a simple and inexpensive laying aid for floor covering elements, in particular ready-made parquet flooring, laminated or floor panels, the laying aid is in the form of a belt tensioning device with a belt and have a shaped part on both sides, each shaped part having a receiving means for the belt, and each shaped part having an arm with a projection which can be fixed at a groove or a tongue of the floor covering elements by engaging in it and around it, respectively. When the arm is fixed in such a manner the receiving means is positioned such that the belt is guided close to the floor covering elements.

12 Claims, 2 Drawing Sheets

LAYING AID FOR PARQUET FLOORING

BACKGROUND OF THE INVENTION

The invention relates to a laying aid for laying ready-made parquet flooring and laminate, a type of ready-made parquet of a smaller size, produced from plastic and not from wood-like materials, like ready-made parquet.

The length of these parquet panels is 1 to 3 m.

During laying it is important for the first three rows or panels to be laid exactly and not to have any spacing whatsoever between them, they must be clamped together with considerable force so that inaccuracies (warping), damage and the glue necessary for connecting them and coated inbetween can be bridged.

The do-it-yourselfer, in particular, who is laying his floor himself, does not necessarily keep to the rule of three rows and should possibly be able to clamp other, in particular, greater lengths as well.

Clamping should be done gently and with a tool for both types of floor paneling.

Clamping tools are known which are suitable for clamping these first three rows, cf. in this respect the embodiment filed under German patent application P 44 04 310.4, the disadvantage of which is, however, that it is too expensive for the do-it-yourselfer to buy, especially since one tool is required for approximately each meter of laying width.

SUMMARY OF THE INVENTION

The object underlying the invention is to provide a laying aid which is also a help to the non-professional and those who lay inventive floor elements only once and is, nevertheless, inexpensive.

This object is accomplished in accordance with the invention, with a laying aid for floor elements, in particular ready-made parquet flooring, laminated or floor panels, in that the laying aid is designed in the form of a belt tensioning device with a belt and has a shaped part on both sides, that each shaped part has a receiving means for the belt, that each shaped part has an arm with a projection which can be fixed at a groove or a tongue of the floor covering elements by engaging in it and around it, respectively, and that when the arm is fixed the receiving means is positioned such that the belt is guided by this close to the floor covering elements.

The advantage of the inventive solution is to be seen in the fact that with it a laying aid is made available which can be used in a simple manner and is inexpensive.

In addition, the inventive solution allows a secure fixing in position on the floor covering elements due to the projection engaging in grooves or around tongues and so there is no risk of the shaped parts slipping off.

In the case of the laying aids previously known, the exact distance to the wall is defined with strips or wedges. In a particularly simple development of the inventive solution, the shaped part is provided with a support element predetermining a distance to the wall.

This support element can be stationarily arranged in the most simple of ways and thus predetermine a fixed distance.

It is, however, particularly advantageous when the distance of the shaped part to the wall can be adjusted with the support element.

In order, in addition, to provide a likewise reliable and damage-free support for the wall, in particular with a varying inclination of the shaped part relative to the wall and, thus, also a varying inclination of the support element, the support element is expediently provided with a convexly curved head which can be rested against the wall.

Furthermore, it is provided, in particular in order to make an inexpensive production possible, for the projection, with which the shaped part can be fixed on the floor covering elements, to form a bend of the arm.

This bend and the arm are preferably dimensioned such that the bend fits into the groove of the floor covering elements and such that it is also capable of engaging around a tongue of the floor covering elements.

In an advantageous embodiment of the inventive solution, which is also concerned, in particular, with avoiding any standing or turning upright of the floor covering elements, it is preferably provided for the laying aid to have a holding-down device which is expediently arranged between the shaped parts.

The holding-down device is expediently designed such that it extends in the direction of the belt to such an extent that it engages over a central floor covering element completely and partially over two floor covering elements arranged laterally of the central one.

A holding-down device of this type is not, however, absolutely necessary. It is also possible to design an inventive belt tensioning device without a holding-down device of this type.

The belt can be tensioned in the most varied of ways. In one advantageous embodiment, the belt can be tensioned by means of a ratchet tensioning device.

When a holding-down device is used, this ratchet tensioning device can be arranged on the holding-down device.

Alternatively thereto, it is advantageously provided for one of the shaped parts to be provided with the ratchet tensioning device.

The ratchet tensioning device may be connected to the shaped part particularly simply when this has a holding element for the ratchet tensioning device.

In order to ensure, in addition, that the belt is guided as low as possible over the floor covering elements, it is advantageously provided for a passage to be arranged in the shaped part bearing the ratchet tensioning device as receiving means for the belt.

For attachment, a simple bent part, which is where possible the same for each side, is used in an expedient embodiment; the bend of this bent part must be designed such that it can be used for all possible floor covering elements and all types of parquet flooring, namely for both sides, not only the groove side but also the tongue side.

On the belt side, it must be designed such that as low a belt guidance as possible results; with a guidance of the belt even at only a very slight height, a tilting up of the clamped panels is to be expected.

The belt can be advantageously held stationarily on the bent part on one side and the second side can be used for direct tightening.

For the purpose of tensioning the belt, known tensioning devices can, for example, be utilized; the most well known is that used for clamping straps. This is a ratchet tensioning device produced from sheet metal parts, with which the belt is wound around the ratchet shaft.

Such a ratchet tensioning device can be secured directly on a bent part on one side or be located on a third part which can be arranged in the center of the belt, also for simultaneous stabilization.

An expedient solution provides for the parquet laying aid to be designed in the form of a belt tensioning device with, for example, a ratchet tensioning device, such as that used in the case of clamping straps, for the winding up and tensioning of the belt and to be provided with a sheet-metal bent part on each side, these parts each being designed with a catch for forming a belt loop. The sheet-metal bent parts are of the same design in their arm length and the second bend and their measurements determined such that the second bend fits into a groove in the ready-made parquet and in the laminate and engages around the tongue of the ready-made parquet and of the laminate with the same dimensions without slipping off and the belt can be guided along the panel in as low a position as possible.

An additional, advantageous parquet laying aid provides for the bent part to have a support element towards the wall for adjusting the distance to the wall, preferably with a concave head for compensating the possible inclined positions of the sheet-metal bent part.

Another, advantageous parquet laying aid provides for a holding-down device to be provided centrally over a plurality of panels, for example, the first three, this device also covering part of each of the rows located adjacent thereto, for example the first row and third row.

Another, favorable parquet laying aid provides for the known tensioning element, preferably a ratchet tensioning device, to be secured to one of the bent parts which means that a holding-down device can be omitted, only an end loop being, however, required.

An additional, expedient parquet laying aid provides for the sheet-metal bent part to be designed such that existing bore holes are used for the securing to the sheet-metal bent part together with a support on the sheet-metal bent part for fixing the ratchet tensioning device.

An additional, advantageous parquet laying aid provides for a leadthrough groove to be provided in the sheet-metal bent part beneath the wind-up roller, this groove contributing to the required, low guidance of the belt on the panel.

The invention and its advantages are described in greater detail in the following on the basis of several embodiments, in conjunction with the attached drawings.

DETAILED DESCRIPTION OF THE INVENTION

Figure 1:
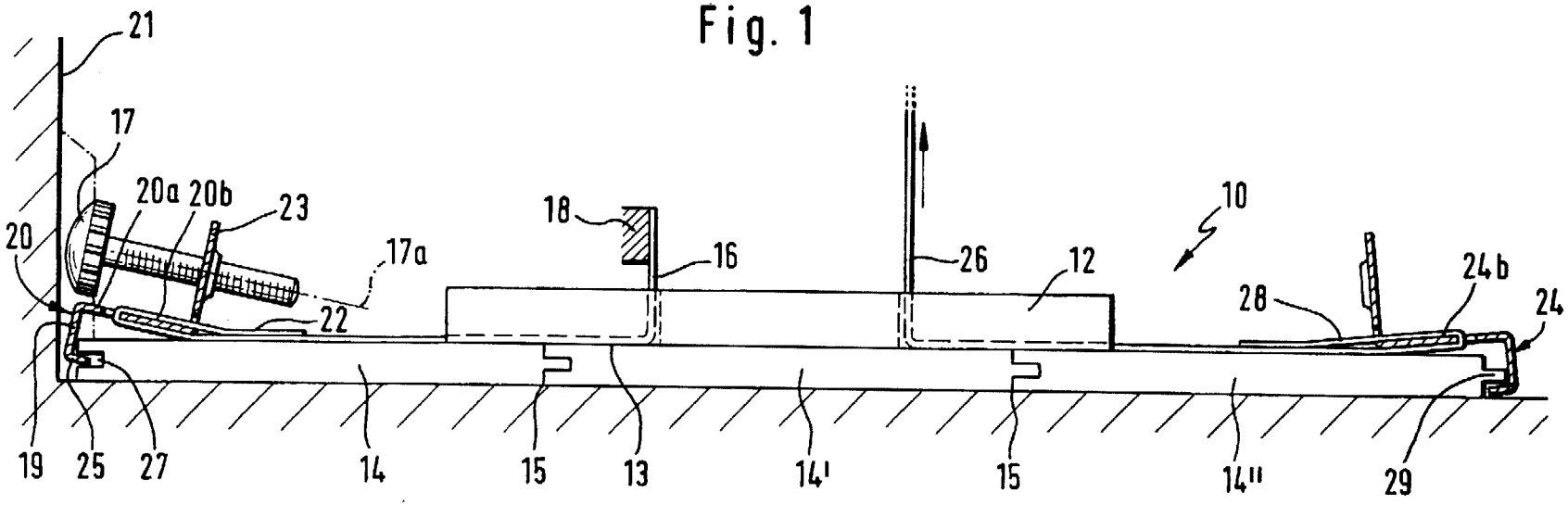
FIG. 1 shows a side view of the assembly aid with a tensioning element arranged centrally (first embodiment)

A first embodiment of a laying aid, designated in FIG. 1 as 10, for laying, for example, three panels 14, 14' and 14" comprises a holding-down device 12 which engages over the central panel 14' as well as the connecting joints 15 and 15' located on both sides thereof and also extends partially over the panels 14 and 14".

A belt 16 is provided with one end fixed to a locating point 18 of the holding-down device 12. The belt proceeds from the locating point 18 through the holding-down device 12 and along an underside 13 thereof in the direction of a first shaped part which is designated as a whole as 20 and is produced in the simplest case as a bent part consisting of sheet metal. The belt 16 forms at its end held on the shaped part 20 a fixed loop or loop which is designated as a whole as 22 and is fixed on the shaped part 20 in a receiving means **20*b* designed, for example, as a side bar of the shaped part 20**.

This means that with a fixed length of the belt 16 the shaped part 20 is arranged at a predetermined distance from the holding down device 12.

A second shaped part 24 is provided opposite the first shaped part 20 and proceeding from this a belt 26, likewise fixed in a receiving means **24*b* of the shaped part 24 with a loop 28, extends to the holding-down device 12 and is guided along an underside 13 of the holding-down device 12, extending as far as a passage through the holding-down device 12 and after being guided through the holding-down device 12** extends to a tensioning element which is also designed, for example, as a so-called commercial ratchet tensioning device.

For the functioning of the inventive laying aid it is essential that the belts 16 and 26 be guided as low as possible on or over the panels 14, 14' and 14", if possible resting on them, in order to avoid any premature tilting of the panels.

In an advantageous variation of the inventive shaped parts 20 or 24 it is provided for these to have a support element 17 which is designed, for example, as a screw with a convex or curved head for the defined positioning of a distance of these shaped parts from a wall 21. The support element designed in the form of the screw can be screwed into a wall region 23 projecting upwards above the panels 14 from the shaped part so that the support element 17 designed as a screw extends transversely to the wall 21 with its axis **17*a* and thus can define different distances of the shaped part 20 from the wall 21 depending on the depth, by which it is screwed into the wall region 23**.

The shaped part 20 has, in addition, an arm 19 which extends transversely to a base plate **20*a* of the shaped part 20 supporting the receiving means 20*b* and bears a projection 25** produced, for example, as a bend.

The arm 19 is thereby designed such that it engages over a longitudinal side edge of an external panel 14 and engages with the projection 25 into a groove 27 thereof. If the panels 14, 14' and 14" are panels consisting of a so-called laminate, a type of ready-made parquet of a smaller size, produced from plastic and not from wood-like materials, like ready-made parquet flooring, the base plate **20*a* can extend at an angle to an upper side of the panel 14**.

The shaped part 24 is also designed in the same way, whereby in this case the projection 25 engages around a tongue 29 at a longitudinal side edge of the outermost panel 14", preferably likewise consisting of a laminate.

Figure 2:
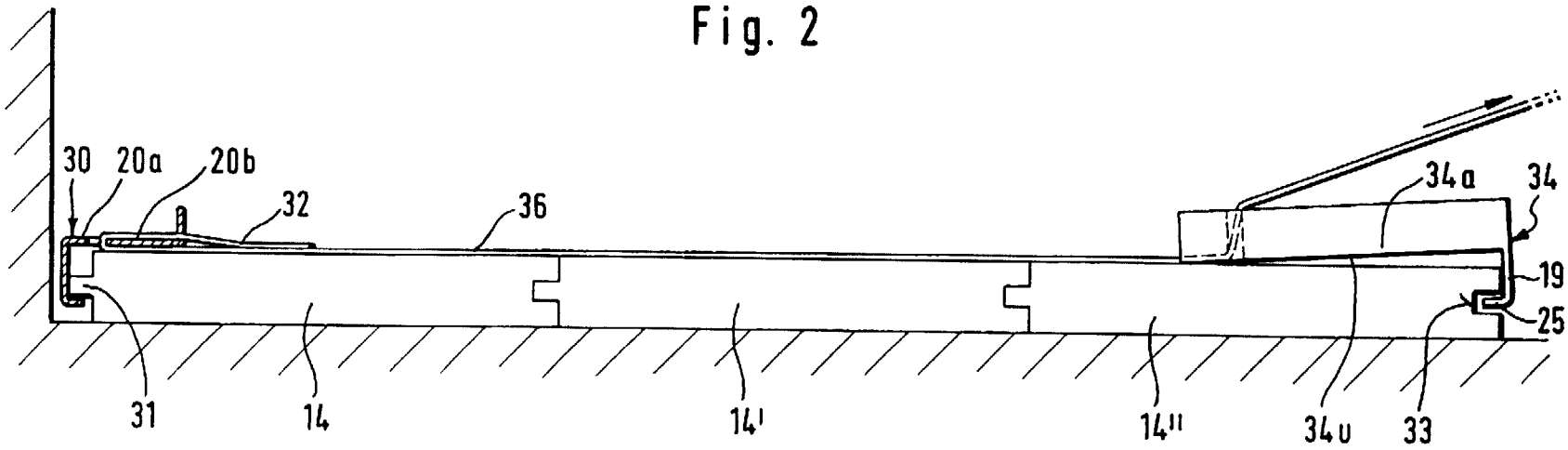
FIG. 2 shows a side view with a tensioning element secured to the shaped part (second embodiment) and FIG. 3 shows a view of the ratchet tensioning device of a clamping strap on the shaped part.

If, instead of a laminate, panels 14, 14' and 14" consisting of ready-made parquet are used, as illustrated in FIG. 2, which has, in particular, a greater thickness, the arms 19 of the shaped parts 20 and 24 are likewise of a sufficient length so that when base plate **20*a*, 34*a* rests on the panels the projection 25 is either in a position to engage in a groove 33 of the panels or engage around a tongue 31** thereof.

In an advantageous variation of the first embodiment, a holding-down device 12 covers the two connecting joints 15 of the three panels 14' to 14"'. The belt 16 extends from a locating point 18 on the holding-down device 12 through a side bar of the bent part 20 and ends as a fixed loop 22; belt 16 therefore has a fixed length. From the bent part 24 on the opposite side, the belt piece 26 extends from an end loop 28 as far as the holding-down device 12 and through it to the tensioning element used. For its functioning it is essential for the belt 16 and 26 to be guided low on the panel to avoid any premature tilting. On one of the bent parts, a screw 71 having a concave head shape can, for example, be provided in the vertically arranged wall of the bent part for fixing the distance to the wall 21.

In a second embodiment of an inventive laying aid, illustrated in FIG. 2, the shaped part 30 does not comprise any support element but is, however, designed in the same manner as the shaped parts 20 or 24 with respect to the arm 19 and the projection 25. As for the rest, the shaped part 30 also has the receiving means **20*b* for an end loop 32 of a belt 36 which is thereby connected to the shaped part 30**.

In contrast to the first embodiment, the second shaped part 34 is not, however, designed like the first shaped part 30 but a base plate **34*a* thereof is of an enlarged design, for mounting a tensioning element directly on the shaped part 34**.

The shaped part 34 does, however, still have an arm 19 designed in the same way as with the shaped parts 20 and 24 and having a projection 25 which, in the same way as with the shaped parts 20 and 24, can be used for fixing the same in position.

The belt 36 held at the shaped part 30 with the loop 32 is guided low along the panels 14, preferably resting on a surface thereof, and extends to the second shaped part 34, then preferably along an underside **34*u* thereof and is guided through the one base plate 34*a* thereof to a tensioning element which is not illustrated in the drawing. In contrast to the first embodiment, the second embodiment of the inventive laying aid, illustrated in FIG. 2, comprises no holding-down device 12 and can be used when a lifting of the panels 14** from the underlying surface is not to be expected or is ensured in another way or a support over three panels is dispensed with.

Figure 3:
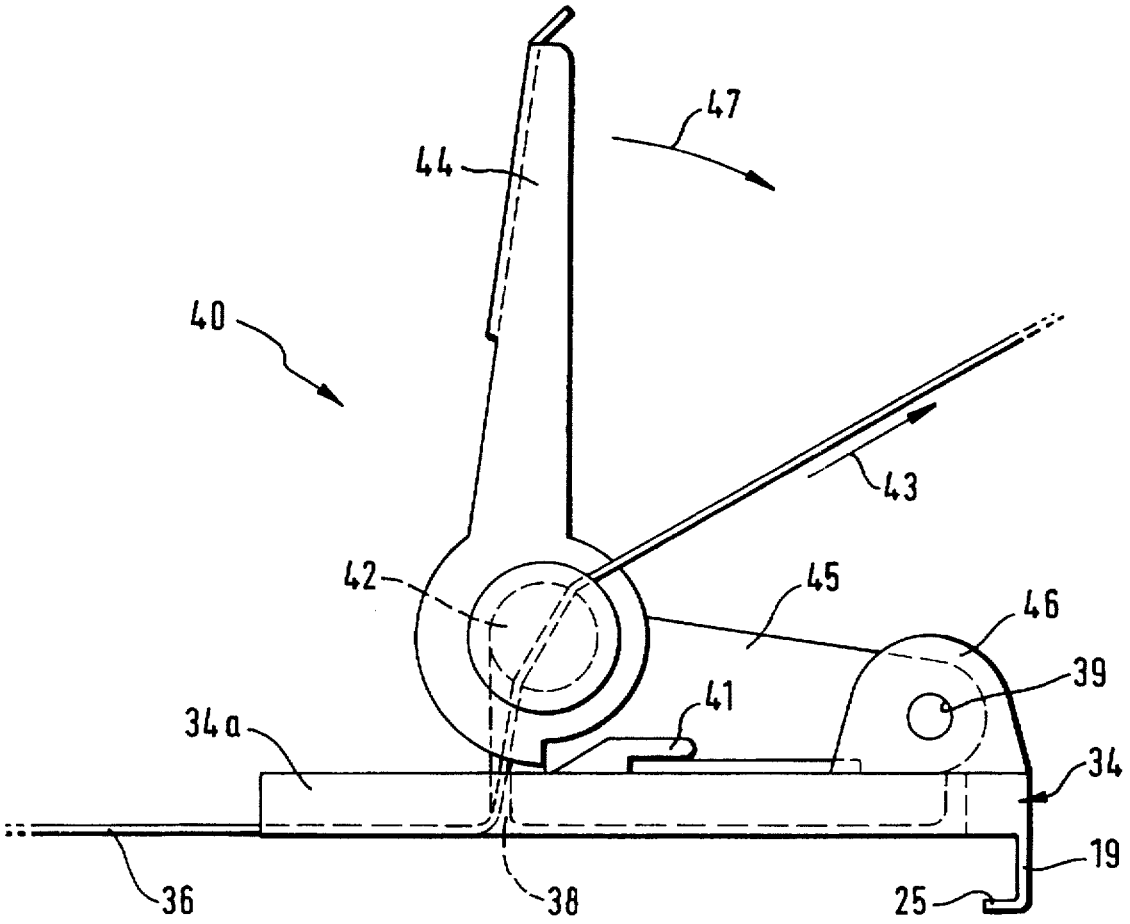

An expedient embodiment of the shaped part 34 is illustrated in FIG. 3. With this solution, a so-called ratchet tensioning device, such as that generally available commercially for the tensioning of belts or straps and designated as a whole as 40, is mounted on the shaped part 34 as tensioning element. For example, a ratchet tensioning device offered by the company Karl Stark GmbH & Co. KG, P.O. Box 12 54, Anhauserstrasse 7, Herbrechtingen as model 01802/4 or 01802YY is used.

The belt 36 guided low along the panel as well as an underside **34*u* of the base plate 34*a* of the shaped part 34 is guided through a passage 38 through the base plate 34*a* of the shaped part 34 to a wind-up roller 42 of the ratchet tensioning device 40, whereby the passage 38 is preferably located beneath the wind-up roller 42. The belt guided through the wind-up roller 42 of the ratchet tensioning device 40 is drawn through the wind-up roller 42 due to traction in the direction of arrow 43** to such an extent that a pretensioning is possible.

The ratchet tensioning device 40 has, on the one hand, a tensioning lever 44 and, on the other hand, a ratchet tensioner body 45 which is fixed, for example, on the shaped part 34 in that a raised wall region 46 of the shaped part 34 is connected to the ratchet tensioner body 45, for example, via a bore 39. In addition, the ratchet tensioner body 45 is fixed on the shaped part 34 by means of an element 41 bent upwards in the shape of a hook, also designated as a support.

By actuating the tensioning lever 44 towards the ratchet tensioner body 45 in the direction of arrow 47, the belt can be rolled up on the wind-up roller 42 in the known manner and thus the panels 14 can be clamped together by means of the belt 36 and by means of the shaped parts 30 and 34. The respective position of the wind-up roller 42 is thereby fixed with a ratchet customary in such a known type of ratchet tensioning device, this ratchet preventing the wind-up roller from winding back.

For an advantageous variation of the second embodiment, FIG. 2 illustrates, on the one hand, how the two bent parts fit into the grooves and tongues of ready-made parquet flooring, these being bent parts which correspond in their size to the designs 20 and 24 for laminate, and, on the other hand, that a central position of the tensioning element can be dispensed with.

The bent part 30 is illustrated without a support element 17. The bent part 34 is designed on an enlarged scale for the mounting of a known tensioning element. The belt 36 has an end loop 32 at the bent part 30 and is again guided low along the panel as far as the bent part 34 and through this to the mounted tensioning element. This design according to FIG. 2 is to be selected when a raising of the panels 14 to 14" is not to be expected or a support over the three panels is dispensed with.

FIG. 3 shows the known ratchet tensioning device, designated as a whole as 40, connected to the bent part 34 as illustrated in FIG. 2. It is, again, essential that the belt be guided low along the panel and only be conducted to the wind-up roller 42 through a groove 38 located beneath it. The belt 36 is illustrated in the zero position and is adjusted and pretensioned in the direction of the arrow. By actuating the tensioning lever 44 in the direction of the arrow, the belt is wound onto the wind-up roller 42 in the known manner. A ratchet on this roller prevents any unwinding.

The present disclosure relates to the subject matter disclosed in International Application No. PCT/EP96/02016 of May 10, 1996, the entire specification of which is incorporated herein by reference.

We claim:

1. A laying aid for floor covering elements comprising:

a belt;

a belt tensioning device adapted to act on said belt;

a pair of shaped parts connected to said belt for movement towards each other when said belt is tensioned by said tensioning device, each of said shaped parts comprising (i) a base plate positionable on an upper side of a corresponding one of said floor covering elements, (ii) an arm extending from the base plate, and (iii) a projection extending from the arm for engaging in a groove or around a tongue of the corresponding floor covering element, said arm and said projection being adapted to fix said base plate at said corresponding floor covering element; and connecting means associated with each of said shaped parts for connecting the shaped part to said belt, said connecting means maintaining said belt in close proximity to the upper side of said floor covering elements when said belt is tensioned to bring said shaped parts towards one another.

2. A laying aid in accordance with claim 1, further comprising:

a support element provided on at least one of said shaped parts, for setting a distance between the at least one shaped part and an adjacent wall.

3. A laying aid in accordance with claim 2 wherein said support element includes means for adjusting said distance.

4. A laying aid in accordance with claim 3, wherein said support element has a convexly curved head for abutting said wall.

5. A laying aid in accordance with claim 1 wherein said projection is formed by a bend in said arm.

6. A laying aid in accordance with claim 5, wherein said bend is dimensioned to interchangeably fit either into said groove or over said tongue.

7. A laying aid in accordance with claim 1, further comprising a hold down device attached to said belt for holding the laying aid on the surface of a floor being constructed from the floor covering elements.

8. A laying aid in accordance with claim 7 wherein the hold down device extends along a longitudinal direction of said belt for a distance that engages completely over a central floor covering element and partially over two additional floor covering elements arranged laterally with respect to the central floor covering element.

9. A laying aid in accordance with claim 1 wherein said belt tensioning device comprises a ratchet.

10. A laying aid in accordance with claim 9 wherein said ratchet is provided on one of said shaped parts.

11. A laying aid in accordance with claim 10 further comprising a holding element for mounting the ratchet to the shaped part on which the ratchet is provided.

12. A laying aid in accordance with claim 11 wherein the shaped part on which the ratchet is provided has a passage for receiving said belt.

* * * * *

UNITED STATES PATENT AND TRADEMARK OFFICE

CERTIFICATE OF CORRECTION

PATENT NO. : 5,765,808

DATED : Jun. 16, 1998

INVENTOR(S) : Ernst Butschbacher, Eschelbronn; Hans Roesch, Gemmrigheim, both of Germany It is certified that error appears in the above-identified patent and that said Letters Patent is hereby corrected as shown below:

On the front page of the patent, left column, immediately above "[30] Foreign Application Priority Data" add:

Related U.S. Application Data

[63] Continuation of PCT/EP96/02016, May 10, 1996.

Column 1 lines 2 and 3, insert the following: --This application is a continuation of International PCT Application No. PCT/EP96/02016, filed on May 10, 1996.--

Signed and Sealed this

Ninth Day of March, 1999

*Attest:*

*Attesting Officer*

Q. TODD DICKINSON

*Acting Commissioner of Patents and Trademarks*